US006432268B1

(12) United States Patent
Burghardt

(10) Patent No.: US 6,432,268 B1
(45) Date of Patent: Aug. 13, 2002

(54) INCREASED HYDROPHOBIC STABILITY OF A SOFTENING COMPOUND

(75) Inventor: Dale A. Burghardt, Butte Des Morts, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/676,200

(22) Filed: Sep. 29, 2000

(51) Int. Cl.[7] ..... D21H 19/16; D21H 21/22; B32B 9/06

(52) U.S. Cl. ..... 162/112; 162/109; 162/127; 162/135; 428/452

(58) Field of Search ..... 428/452; 162/109, 162/112, 128, 127, 135, 164.4, 168.1; 252/182.29, 183.12; 526/82

(56) References Cited

U.S. PATENT DOCUMENTS

| | | | |
|---|---|---|---|
| 3,663,973 | A | 5/1972 | Spence |
| 4,028,172 | A | 6/1977 | Mazzarella |
| 4,551,385 | A | 11/1985 | Robbart |
| 4,857,251 | A | 8/1989 | Nhor et al. |
| 4,920,168 | A | 4/1990 | Nohr et al. |
| 4,950,545 | A | 8/1990 | Walter et al. |
| 5,059,282 | A | 10/1991 | Ampulski et al. |
| 5,085,920 | A | 2/1992 | Nohr et al. |
| 5,164,046 | A | 11/1992 | Ampulski et al. |
| 5,215,626 | A | 6/1993 | Ampulski et al. |
| 5,227,242 | A | 7/1993 | Walter et al. |
| 5,246,546 | A | 9/1993 | Ampulski |
| 5,385,643 | A | 1/1995 | Ampulski |
| 5,389,204 | A | 2/1995 | Ampulski |
| 5,529,665 | A | 6/1996 | Kaun |
| 5,567,372 | A | 10/1996 | Nohr et al. |
| 5,569,732 | A | 10/1996 | Nohr et al. |
| 5,580,566 | A | 12/1996 | Syverson et al. |
| 5,601,871 | A | 2/1997 | Krzysik et al. |
| 5,607,760 | A | 3/1997 | Roe |
| 5,614,293 | A | 3/1997 | Krzysik et al. |
| 5,624,676 | A | 4/1997 | Mackey et al. |
| 5,635,191 | A | 6/1997 | Roe et al. |
| 5,643,588 | A | 7/1997 | Roe et al. |
| 5,650,218 | A | 7/1997 | Krzysik et al. |
| 5,665,426 | A | 9/1997 | Krzysik et al. |
| 5,705,164 | A | 1/1998 | Mackey et al. |
| 5,707,434 | A | 1/1998 | Halloran et al. |
| 5,707,435 | A | 1/1998 | Halloran |
| 5,763,334 | A | 6/1998 | Gupta et al. |
| 5,869,075 | A | 2/1999 | Krzysik |
| 5,885,697 | A | 3/1999 | Krzysik et al. |
| 6,054,020 | A | 4/2000 | Goulet et al. |
| 6,179,961 | B1 * | 1/2001 | Ficke et al. ..... 162/127 |

FOREIGN PATENT DOCUMENTS

| | | |
|---|---|---|
| CA | 2118529 | 2/1996 |
| EP | 0607796 A1 | 7/1994 |
| EP | 0770725 A2 | 5/1997 |
| EP | 0 803527 A1 | 10/1997 |
| JP | 83004937 B | 1/1983 |
| JP | 6220327 A | 8/1994 |
| JP | 8283693 A | 10/1996 |
| SU | 1511303 A1 | 9/1989 |
| WO | 9429325 | 12/1994 |
| WO | WO 01/48312 | 7/2001 |

* cited by examiner

*Primary Examiner*—Philip Tucker
*Assistant Examiner*—Michael J Feely
(74) *Attorney, Agent, or Firm*—Dority & Manning, P.A.

(57) ABSTRACT

A tissue product applied with a softening treatment is provided. The softening treatment contains a softening compound, such as a amino-functional polysiloxane, and a polymerization inhibitor. The polymerization inhibitor inhibits cross-linking of the softening compound when subjected to non-ideal conditions, e.g., stored for 8 weeks at 100° F. and 80% relative humidity. In some embodiments, for example, the polymerization inhibitor can be an alkyl siloxane, such as hexamethyl disiloxane.

27 Claims, No Drawings

INCREASED HYDROPHOBIC STABILITY OF A SOFTENING COMPOUND

BACKGROUND OF THE INVENTION

Absorbent tissue products such as paper towels, facial tissues, bath tissues, napkins, and other similar products are designed to include several important properties. For example, the products should have good bulk, a soft feel and should be highly absorbent. Unfortunately, in some instances, it is difficult to produce a tissue product that is soft and also absorbent.

For instance, silicone compositions are sometimes added to a tissue product to improve softness. However, in some cases, the application of the silicone composition can result in a tissue product with reduced absorbency. For example, a tissue product applied with a silicone composition is often stored in warehouses between the time it is manufactured and the time it is shipped to distributors. During such time period, the tissue product may be subjected to various non-ideal conditions, e.g., elevated temperatures and humidity levels, extended periods of time, etc. While subjected to such conditions, it has been found that the absorbent capabilities of the tissue product decreases.

Consequently, a need currently exists for an improved tissue product that is soft and absorbent. A need also exists for a tissue product containing an improved softening composition that promotes hydrophobic stability.

SUMMARY OF THE INVENTION

The present invention is directed to a tissue product including a paper web containing cellulosic fibers and a softening treatment applied to at least one surface of the paper web. The softening treatment includes a softening compound and a polymerization inhibitor.

In one embodiment, for example, the softening compound can contain an amino-modified polysiloxane that bonds to the fibers in the paper web. Further, in some embodiments, the softening compound may include a non-amino modified polysiloxane. In some embodiments, the non-amino modified polysiloxane may be combined with the amino-modified polysiloxane to form an emulsion. In other embodiments, the polysiloxanes can be separately applied to the tissue product, such as in separate emulsions or solutions.

As stated above, the softening treatment also includes a polymerization inhibitor that is capable of inhibiting the polymerization of the softening compound when the compound is subjected to non-ideal conditions. In general, any compound or molecule that can inhibit the polymerization of another compound or molecule under certain conditions can be utilized as a polymerization inhibitor in the present invention. For example, in some embodiments, the polymerization inhibitor can contain a siloxane compound having the following formula:

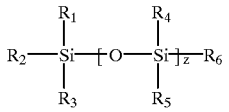

wherein z is an integer greater than 0. Typically, z is less than or equal to 10, and particularly less than or equal to 6. In one embodiment, for example, z is equal to 1 so that the resulting polymerization inhibitor is a disiloxane. The $R_1$–$R_6$ moieties can be $C_1$ or greater alkyl stubstituents.

In one particular embodiment, an alkyl disiloxane may be utilized, such as hexamethyl disiloxane having the following formula:

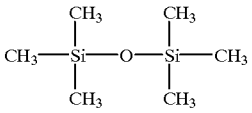

Although not required, the molecular weight of the polymerization inhibitor can be less than the molecular weight of the polysiloxane softening compound. For example, in some embodiments, the molecular weight of the polymerization inhibitor can be from about 100 to about 1000, and particularly between about 145 to about 450.

The polymerization inhibitor may be combined with the softening compound before or after the softening compound is applied to the tissue product. For example, in one embodiment, a polymerization inhibitor is combined with an amino-functional polysiloxane compound to form a softening treatment that is then emulsified in water using an appropriate surfactant. In another embodiment, the polymerization inhibitor is combined with an already emulsified amino-functional polysiloxane compound to form the softening treatment.

In general, the polymerization inhibitor may be present in the mixture or emulsion in any amount. For example, in one embodiment, the polymerization inhibitor is present in an amount from about 1% to about 50% by weight of the total weight of the softening treatment, and particularly from about 1% to about 20%. In one particular embodiment, for instance, an emulsion is formed containing about 35% by weight of polysiloxane solids, about 2% by weight hexamethyl disiloxane, with the balance of the treatment weight being water, a surfactant, and/or other emulsifying materials.

Other features and aspects of the present invention are discussed in greater detail below.

DETAILED DESCRIPTION OF THE REPRESENTATIVE EMBODIMENTS

Reference now will be made in detail to various embodiments of the invention, one or more examples of which are set forth below. Each example is provided by way of explanation, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

In general, the present invention is directed to various tissue products with improved softness and higher hydrophobic stability. In particular, the present invention is directed to the utilization of a polymerization inhibitor in conjunction with a softening compound applied to a tissue product. For example, in one embodiment, a hexamethyl disiloxane polymerization inhibitor can be combined with a polysiloxane softening compound to inhibit further polymerization of the polysiloxane compound, thereby maintaining the relative hydrophilic properties of the tissue product.

Tissue products made according to the present invention can generally be formed in a variety of ways. For example, the tissue product can be a single or multi-ply tissue. Moreover, in some instances, one or more plies of a tissue can contain multiple layers of fibrous materials. In addition, the basis weight of a tissue product made according to the present invention can, in some embodiments, range from about 10 grams per square meter to about 70 grams per square meter.

The tissue product of the present invention can also be formed from a variety of different materials. In particular, a variety of natural and/or synthetic fibers can be used. For example, some suitable natural fibers include, but are not limited to, nonwoody fibers, such as abaca, sabai grass, milkweed floss fibers, pineapple leaf fibers; softwood fibers, such as northern and southern softwood kraft fibers; hardwood fibers, such as eucalyptus, maple, birch, aspen, and the like. In addition, furnishes including recycled fibers may also be utilized. Moreover, some suitable synthetic fibers include, but are not limited to, hydrophilic synthetic fibers, such as rayon fibers and ethylene vinyl alcohol copolymer fibers, as well as hydrophobic synthetic fibers, such as polyolefin fibers.

Further, the tissue product of the present invention can be formed according to various papermaking processes known in the art. In particular, any process capable of forming a paper web can be utilized in the present invention. For example, the papermaking process can utilize creeping, embossing, wet-pressing, through-drying, through-dry creeping, uncreped through-drying, double creeping, as well as other steps and methods used to form a multilayered paper web.

In accordance with the present invention, a softening compound is also applied to the tissue product to improve the softness thereof. In general, any softening compound capable of polymerizing under certain conditions can be used in the present invention. For example, in some embodiments, the softening compound can include one or more emulsions containing a polysiloxane compound. Some examples of such polysiloxane compounds are described in U.S. Pat. No. 6,054,020 to Goulet, et al., which is incorporated herein in its entirety by reference thereto for all purposes.

For instance, in one particular embodiment, the softening composition can contain an emulsion containing a generally hydrophobic amino-functional polysiloxane or similar compound that is capable of bonding to the surface of the paper web. Such a polysiloxane compound may have the following general formula:

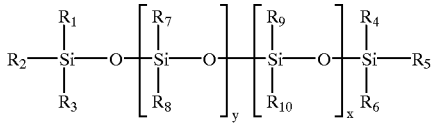

wherein x and y are integers >0 and the mole ratio of x to (x +y) is from about 0.005 percent to about 25 percent. The $R_1$–$R_9$ moieties can be $C_1$ or greater alkyl stubstituents. Additionally, $R_2$ and $R_5$ can be hydroxyl or $C_1$ or greater alkyl alcohol stubstituents. Particular $R_1$–$R_9$ moieties can include $C_1$–$C_4$. The $R_{10}$ moiety can include any amine-related functional group or groups such as an amine, imine, and/or amide.

For example, the amino-functional polysiloxane can be a polysiloxane where the $R_{10}$ moiety contains one amine group per substituent or two or more amine groups per substituent, separated by a linear or branched alkyl chain of $C_1$ or greater.

In some embodiments, other polysiloxane materials which are suitable for blending or mixing with the amino-functional polysiloxane(s) for purposes of balancing hydrophobicity may also be utilized. One example of such polysiloxanes has the following formula:

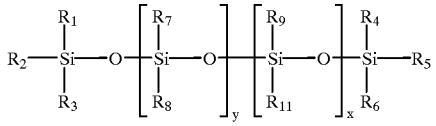

wherein x and y are integers >0. The mole ratio of x to (x+y) can be $C_1$ from 0.005 percent to about 25 percent. The $R_1$–$R_9$ moieties can be C, or greater alkyl substituents. Additionally, $R_2$ and $R_5$ can be hydroxyl or $C_1$ or greater alkyl alcohol substituents. Particular $R_1$–$R_9$ moieties include $C_1$–$C_4$. The $R_{11}$ moiety can include organic functional groups such as ether, polyether, ester, amine, imine, amide, or other functional groups, including the alkyl and alkenyl analogues of such functional groups.

As an example, the $R_{11}$ moiety can be a polyether functional group of the generic form $—R_{12}—(R_{13}—O)_a—(R_{14}—O)_b—R_{15}$; wherein $R_{12}$, $R_{13}$ and $R_{14}$ are alkyl chains of $C_1$ or greater, $R_{15}$ can be hydrogen or a $C_1$ $C_4$ alkyl group, and "a" and "b" can be integers of from 1–100, more specifically from 10–30.

The viscosity range of the amino-functional polysiloxane, which is indicative of the molecular weight, can be from about 25 centipoise to about 2,000,000 centipoise or higher, more specifically from about 100 to about 1,000,000 centipoise.

Furthermore, in some embodiments, other siloxane compounds may be utilized as well. In one embodiment, for instance, a generally hydrophilic non-amino functional polysiloxane compound can be utilized in conjunction with the amino-functional polysiloxane. Non-amino functional polysiloxanes do not typically have a high affinity for bonding with the paper fibers of the tissue product, but are often attracted to the amino-functional polysiloxane compounds. In some instances, such non-amino functional polysiloxane compounds can also be modified to incorporate one or more beneficial chemical compounds.

Several examples of non-amino functional polysiloxanes that can be modified by a chemically beneficial additive include methyl dimethyl siloxane, polydimethyl siloxane, other alkyl siloxanes, siloxanes attached to hydroxyl groups, and siloxanes attached to hydrogen. Moreover, some examples of suitable beneficial chemical agents that can be used include, but are not limited to, anti-inflammatory compounds (e.g., cortisone), lipids, inorganic anions and cations (copper and zinc ions), protease inhibitors, sequestration agents, anti-acne actives, antimicrobial actives, antifungal actives, antiseptic actives, antioxidants, cosmetic astringents, drug astringents, aiological additives, deodorants, emollients, external analgesics, film formers, fragrances, humectants, natural moisturizing agent and other skin moisturizing ingredients known in the art, opacifiers, skin conditioning agents, skin exfoliating agents, skin protectants, solvents, sunscreens, and surfactants.

In addition to these classes of ingredients, small amounts (from about 0.01 to about 20%) of oil soluble/dispersible or lipophilic materials can be easily emulsified into the formulation using anionic, cationic, nonionic and/or zwitterionic surfactants. Lipophilic materials can include oils (minerals, vegetable, and animal), fatty esters and the like. Powders to enhance lubricity, oil absorption, provide skin protection, astringency, opacity, etc. and microencapsulated ingredients can also be dispersed into the formulation.

In some embodiments, one or more polysiloxane compounds may be formed into a single emulsion before applying the compounds to a tissue product. For example, in one embodiment, two polysiloxane compounds (one amino-functional and one non-amino functional) are emulsified in water using an appropriate surfactant before the combination is applied to the surface of the tissue. Moreover, in other embodiments, one or more polysiloxane compounds may be applied to the tissue product through two or more separate emulsions. Further, in some embodiments, the polysiloxane compound(s) can be directly applied to the tissue product without emulsification. For example, in one embodiment, two polysiloxane compounds are applied to the facial tissue at separate times so that the first polysiloxane compound (e.g., amino functional) is first applied to the surface and then the second polysiloxane compound (e.g., non-amino functional) is applied.

Either the emulsion of both the polysiloxanes or each polysiloxane separately may be applied to a facial tissue or other nonwoven by printing, spraying, dipping, coating or the like. For most applications, the polysiloxane emulsion or single polysiloxanes are incorporated into the facial tissue or other nonwoven material after the product has been formed.

In a particular embodiment, either the polysiloxane emulsion or the single polysiloxanes are printed onto a dried, creped tissue sheet between the base sheet manufacturing process and the final tissue product converting process. Printing provides precise control of the add-on amount of the polysiloxane and places the polysiloxane on the surface of the tissue where it is most effective for transferability to the consumer's skin. More specifically, gravure printing is preferred because of the control it offers with respect to the amount of siloxane added to the tissue surface.

As stated above, the tissue product that is treated with the polysiloxane compound typically contains pulp fibers. The tissue product can be a paper towel, a bath tissue, a facial tissue, any other tissue product, or possible any nonwoven material. In some applications, for example, a facial tissue can be treated in accordance with the present invention. The facial tissue can have a density of from about 0.04 grams per cubic centimeter to about 0.3 grams per cubic centimeter and can have a basis weight of from about 4 to about 40 pounds per ream (2,880 square feet). Tensile strength in the machine direction can vary but will generally be in the range of from about 100 to about 5,000 grams per inch of width. Tensile strength in the cross-machine direction can be in the range of from about 50 grams to about 2,500 grams per inch of width. Absorbency for tissue products can be at least about 5 grams of water per gram of fiber, and generally from about 5 to about 9 grams of water per gram of fiber.

In one embodiment, the polysiloxane compound(s) is printed on to a three-ply facial tissue. This is accomplished by first unwinding three rolls of single-ply facial grade creped tissue and then crimping the two together at a given speed. The single-ply facial grade creped tissue may be a blend of softwood fibers and hardwood fibers. The resulting three-ply base sheet is then treated with the polysiloxane emulsion (or with each individual polysiloxane) on both sides using a rotogravure printer, first printing on one side and then the other. Such a rotogravure printer produces a printing pattern that is uniform and provided by printing cells of a certain micron size and spaced apart by a certain number of microns.

Alternative embodiments of the present invention, wherein either the polysiloxane emulsion or each individual polysiloxane is applied to a facial tissue or other nonwoven material by spraying, dipping, or coating serve to cover the entire surface of the facial tissue or other nonwoven material with a modified polysiloxane emulsion. This differs from the above-described embodiment of the present invention in that the printing application of the polysiloxane treatment produces a pattern of treated and untreated areas rather than covering the entire surface.

The amount of the polysiloxane softening compounds that are applied to a tissue product in accordance with the present invention will generally vary with depending upon the product being treated, the composition of the polysiloxane treatment, the beneficial chemical agents used (if at all), the particular application, and desired result. For most applications, however, the polysiloxane softening compounds are added to a base web in an amount from about 0.1% by weight to about 70% by weight, in some embodiments from about 0.1% by weight to about 50% by weight, in some embodiments, in some embodiments from about 0.1% by weight to about 25% by weight, and in some embodiments, from about 0.1% by weight to about 5.0% by weight based on the dry weight of the tissue product.

In some instances, a softening compound containing siloxane molecules, such as described above, often becomes more hydrophobic (i.e., water repellant) when subjected to certain conditions. For example, it has been observed that a tissue product applied with an amino-functional polysiloxane compound can become increasingly more hydrophobic when stored for an extended period of time under non-ideal conditions, such as for 8 weeks at 100° F. and 80% relative humidity. Unfortunately, a hydrophobic tissue product is typically not desired, particularly when used in applications requiring product absorbency. The present inventor has discovered, however, that such an increase in the hydrophobicity of the tissue product is likely due to the polymerization of molecules within the softening compound. For example, it is believed that an amino-functional polysiloxane molecule begins to cross-link with other similar molecules when subjected to non-ideal conditions. This cross-linking creates a compound that has a lower affinity for water molecules, and thus, is more hydrophobic.

As such, in accordance with the present invention, a polymerization inhibitor can be utilized in conjunction with the softening compound to inhibit polymerization of the compound under certain conditions. For example, in one embodiment, the polymerization inhibitor can inhibit cross-linking between one or more polysiloxane molecules, such as described above.

In general, any compound or molecule that can inhibit the polymerization of another compound or molecule under certain conditions can be utilized as a polymerization inhibitor in the present invention. For example, in some embodiments, the polymerization inhibitor can contain a siloxane compound having the following formula:

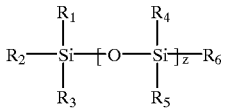

wherein z is an integer greater than 0. Typically, z is less than or equal to 10, and particularly less than or equal to 6. In one embodiment, for example, z is equal to 1 so that the resulting polymerization inhibitor is a disiloxane. The $R_1$–$R_6$ moieties can be $C_1$ or greater alkyl substituents. Particular $R_1$–$R_6$ moieties include methyl groups. Examples of some suitable compounds that may be used for polymerization inhibitors include, but are not limited to, octamethyl trisiloxane, decamethyl tetrasiloxane, dodecamethyl pentasiloxane, and tetradecamethyl hexasiloxane. In one particular embodiment, an alkyl disiloxane may be utilized, such as hexamethyl disiloxane having the following formula:

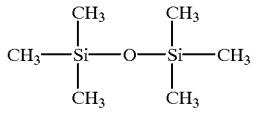

Although not required, the molecular weight of the polymerization inhibitor is typically less than the molecular weight of the polysiloxane softening compound. In particular, the effectiveness of a polymerization inhibitor used in the present invention sometimes decreases with increasing molecular weight. Accordingly, in some embodiments, the molecular weight of the inhibitor can be from about 100 to about 1000, and particularly between about 145 to about 450.

The polymerization inhibitor may be combined with the softening compound before or after the softening compound is applied to the tissue product. For example, in one embodiment, a polymerization inhibitor is combined with an amino-functional polysiloxane compound to form a softening treatment that is then emulsified in water using an appropriate surfactant. In another embodiment, the polymerization inhibitor is combined with an already emulsified amino-functional polysiloxane compound to form the softening treatment.

The polymerization inhibitor may be present in the mixture or emulsion in an amount from about 1% to about 50% by total weight of the mixture or emulsion, and particularly from about 1% to about 20%. Typically, the amount of polymerization inhibitor utilized depends on the polysiloxane solids content within the emulsion. For example, in one embodiment, an emulsion is formed containing about 35% by weight of polysiloxane compounds and about 2% by weight hexamethyl disiloxane.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A tissue product comprising:

a paper web containing cellulosic fibers, said paper web having at least one surface; and a softening treatment applied to said at least one surface of said paper web, said softening treatment comprising a softening compound and a polymerization inhibitor, said polymerization inhibitor being capable of inhibiting the polymerization of said softening compound when said softening compound is subjected to non-ideal conditions.

2. A tissue product as defined in claim 1, wherein said softening compound comprises a polysiloxane compound.

3. A tissue product as defined in claim 2, wherein said softening compound comprises a polysiloxane having an amine-related functional group, wherein said polysiloxane is represented by the following formula:

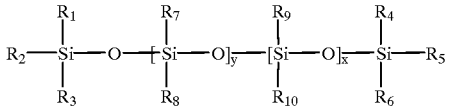

wherein x and y are integers greater than 0 and the mole ratio of x to (x+y) is from about 0.005 percent to about 25 percent, $R_1$, $R_3$, $R_4$, $R_6$–$R_9$ are alkyl groups, $R_2$ and $R_5$ are alkyl groups, hydroxyl groups or alkyl alcohol groups, and $R_{10}$ comprises an amine group, an imine group, or an amide group.

4. A tissue product defined in claim 3, wherein said softening treatment further comprises another polysiloxane having the following formula:

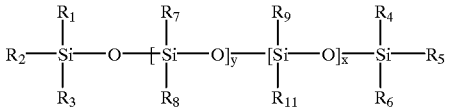

wherein x and y are integers greater than 0 and the mole ratio of x to (x+y) is from about 0.005 percent to about 25 percent, $R_1$, $R_3$, $R_4$, $R_6$–$R_9$ are alkyl groups, $R_2$ and $R_5$ are alkyl groups, hydroxyl groups or alkyl alcohol groups, and $R_{11}$ comprises an ether, a polyether, an ester, an amine, an imine, an amide, or alkyl and alkenyl analogues thereof.

5. A tissue product as defined in claim 1, wherein said polymerization inhibitor comprises a siloxane having the following chemical formula:

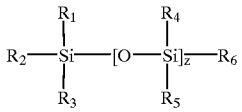

wherein $0<z\leqq 10$ and $R_1$–$R_6$ are alkyl groups.

6. A tissue product as defined in claim 5, wherein $z\leqq 6$.

7. A tissue product as defined in claim 1, wherein said polymerization inhibitor has the following chemical formula:

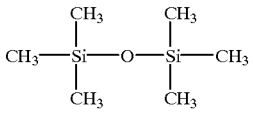

8. A tissue product as defined in claim 1, wherein said polymerization inhibitor has a molecular weight less than about 1000.

9. A tissue product as defined in claim 1, wherein said polymerization inhibitor has a molecular weight less than about 450.

10. A tissue product as defined in claim 1, wherein said polymerization inhibitor comprises between about 1% to about 50% by weight of the total weight of said softening treatment.

11. A tissue product as defined in claim 1, wherein said polymerization inhibitor comprises between about 1% to about 20% by weight of the total weight of said softening treatment.

12. A tissue product as defined in claim 1, wherein said softening treatment is applied to said paper web in the form of an emulsion.

13. A tissue product comprising: a paper web containing cellulosic fibers, said paper web having at least one surface; and a softening treatment applied to said at least one surface of said paper web, said softening treatment comprising a softening compound and a polymerization inhibitor, said polymerization inhibitor being capable of inhibiting the polymerization of said softening compound when said softening compound is subjected to non-ideal conditions, said softening compound comprising a polysiloxane having an amine-related functional group and said polymerization inhibitor comprising a siloxane compound.

14. A tissue product as defined in claim 13, wherein said softening compound has the following formula:

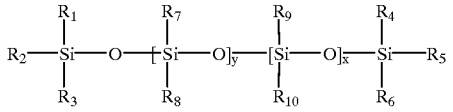

wherein x and y are integers greater than 0 and the mole ratio of x to (x+y) is from about 0.005 percent to about 25 percent, $R_1$, $R_3$, $R_4$, $R_6$–$R_9$ are alkyl groups, $R_2$ and $R_5$ are alkyl groups, hydroxyl groups or alkyl alcohol groups, and $R_{10}$ comprises an amine group, an imine group, or an amide group.

15. A tissue product as defined in claim 14, wherein said softening treatment further comprises another polysiloxane having the following formula:

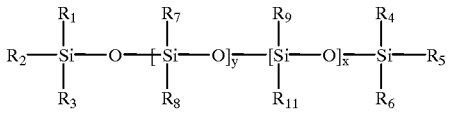

wherein x and y are integers greater than 0 and the mole ratio of x to (x+y) is from about 0.005 percent to about 25 percent, $R_1$, $R_3$, $R_4$, $R_6$–$R_9$ are alkyl groups, $R_2$ and $R_5$ are alkyl groups, hydroxyl groups or alkyl alcohol groups, and $R_{11}$ comprises an ether, a polyether, an ester, an amine, an imine, an amide, or alkyl and alkenyl analogues thereof.

16. A tissue product as defined in claim 13, wherein said polymerization inhibitor comprises a siloxane having the following chemical formula:

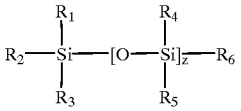

wherein $0<z\leqq 6$ and $R_1$–$R_6$ are alkyl groups.

17. A tissue product as defined in claim 13, wherein said polymerization inhibitor has the following chemical formula:

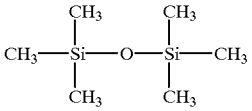

18. A tissue product as defined in claim 13, wherein said polymerization inhibitor has a molecular weight less than about 1000.

19. A tissue product as defined in claim 13, wherein said polymerization inhibitor has a molecular weight less than about 450.

20. A tissue product as defined in claim 13, wherein said polymerization inhibitor comprises between about 1% to about 50% by weight of the total weight of said softening treatment.

21. A tissue product as defined in claim 13, wherein said polymerization inhibitor comprises between about 1% to about 20% by weight of the total weight of said softening treatment.

22. A tissue product as defined in claim 13, wherein said softening treatment is applied to said paper web in the form of an emulsion.

23. A tissue product comprising: a paper web containing cellulosic fibers, said paper web having at least one surface; and a softening treatment applied to said at least one surface of said paper web, said softening treatment comprising a softening compound having the following chemical structure:

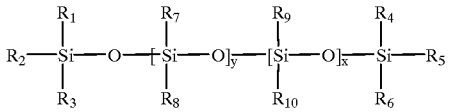

wherein x and y are integers greater than 0 and the mole ratio of x to (x+y) is from about 0.005 percent to about 25 percent, $R_1$, $R_3$, $R_4$, $R_6$–$R_9$ are alkyl groups, $R_2$ and $R_5$ are alkyl groups, hydroxyl groups or alkyl alcohol groups, and $R_{10}$ comprises an amine group, an imine group, or an amide group; and said softening treatment further comprising a polymerization inhibitor being capable of inhibiting the polymerization of said softening compound when said softening compound is subjected to non-ideal conditions, said polymerization inhibitor having the following chemical structure:

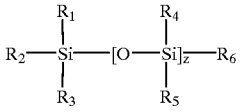

wherein $0<z\leqq 10$ and $R_1$–$R_6$ are alkyl groups.

24. A tissue product as defined in claim 23, wherein $z\leqq 6$.

25. A tissue product as defined in claim 23, wherein said polymerization inhibitor has the following chemical formula:

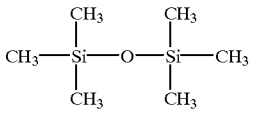

26. A tissue product as defined in claim 23, wherein said polymerization inhibitor has a molecular weight less than about 450.

27. A tissue product as defined in claim 23, wherein said polymerization inhibitor comprises between about 1% to about 20% by weight of the total weight of said softening treatment.

* * * * *